US006637864B2

(12) United States Patent
Dewey et al.

(10) Patent No.: US 6,637,864 B2
(45) Date of Patent: Oct. 28, 2003

(54) INK SUPPLY SYSTEM FOR AN INK JET PRINTER

(75) Inventors: Jason S. Dewey, San Diego, CA (US); David A. Neese, Escondido, CA (US); Marni D. Ines, San Diego, CA (US); Dennis J. Astroth, Poway, CA (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/044,305

(22) Filed: Jan. 11, 2002

(65) Prior Publication Data

US 2002/0113837 A1 Aug. 22, 2002

Related U.S. Application Data

(60) Provisional application No. 60/262,234, filed on Jan. 16, 2001.

(51) Int. Cl.[7] ..... B41J 2/14; B41J 23/00
(52) U.S. Cl. ..... 347/49; 347/37
(58) Field of Search ..... 347/49, 37, 39

(56) References Cited

U.S. PATENT DOCUMENTS 5,880,764 A 3/1999 Barinaga
5,971,531 A 10/1999 Dietl et al.
5,992,986 A 11/1999 Gyotoku et al.
6,007,190 A * 12/1999 Murray et al. ..... 347/86
6,015,209 A 1/2000 Barinaga et al.
6,024,443 A 2/2000 Muhl et al.
6,033,061 A 3/2000 Niedermeyer et al.
6,145,968 A * 11/2000 Fries et al. ..... 347/85
6,386,681 B1 * 5/2002 Askren et al. ..... 347/49

* cited by examiner

*Primary Examiner*—Judy Nguyen
(74) *Attorney, Agent, or Firm*—Milton S. Sales; Thomas R. Arno

(57) ABSTRACT

A device and method for supplying ink to ink jet printer heads comprising first and second carriage portions non-rigidly coupled such that the two carriage portions are free to rotate independently about their guide rod axis, but are constrained to move together axially. The first carriage portion contains one or more ink jet cartridges supplied with ink via connecting tubes having self-sealing septum attached to corresponding ink outlets on the second carriage portion. The ink outlets on the second carriage portion preferably comprise valves with actuators. The actuators preferably act to secure the septum within the ink outlets, and are preferably disposed such that the valve is closed when the actuator is raised, and open when the actuator is lowered.

22 Claims, 8 Drawing Sheets

FIG. 7
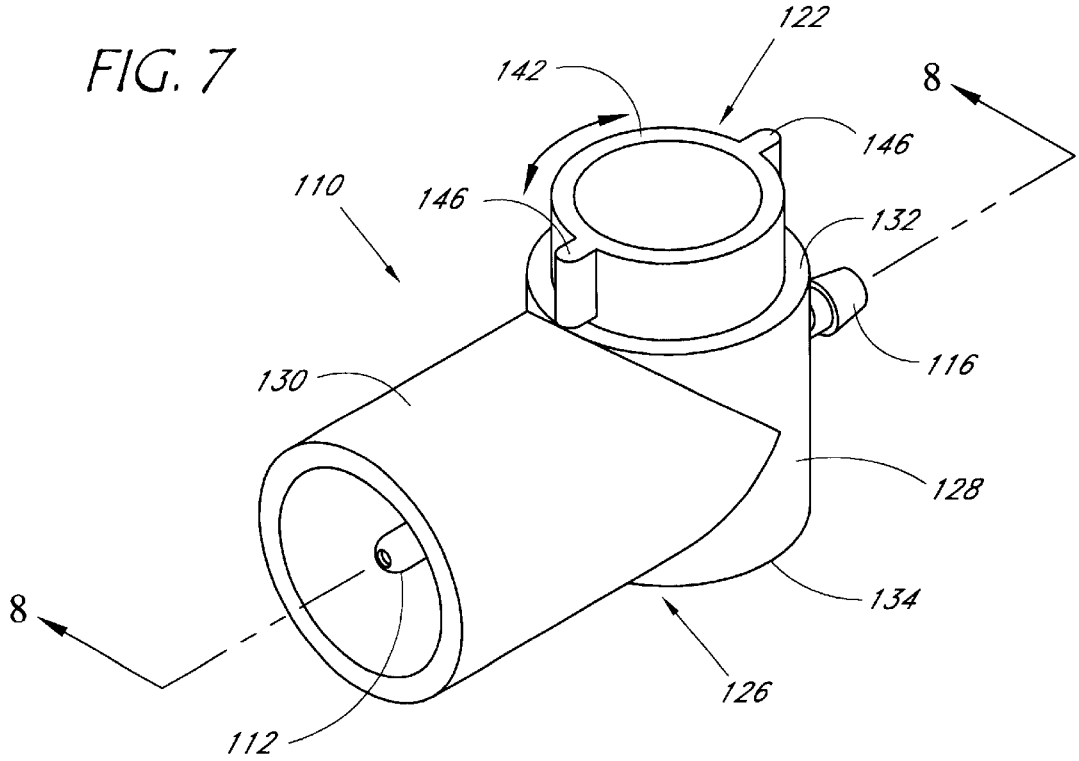
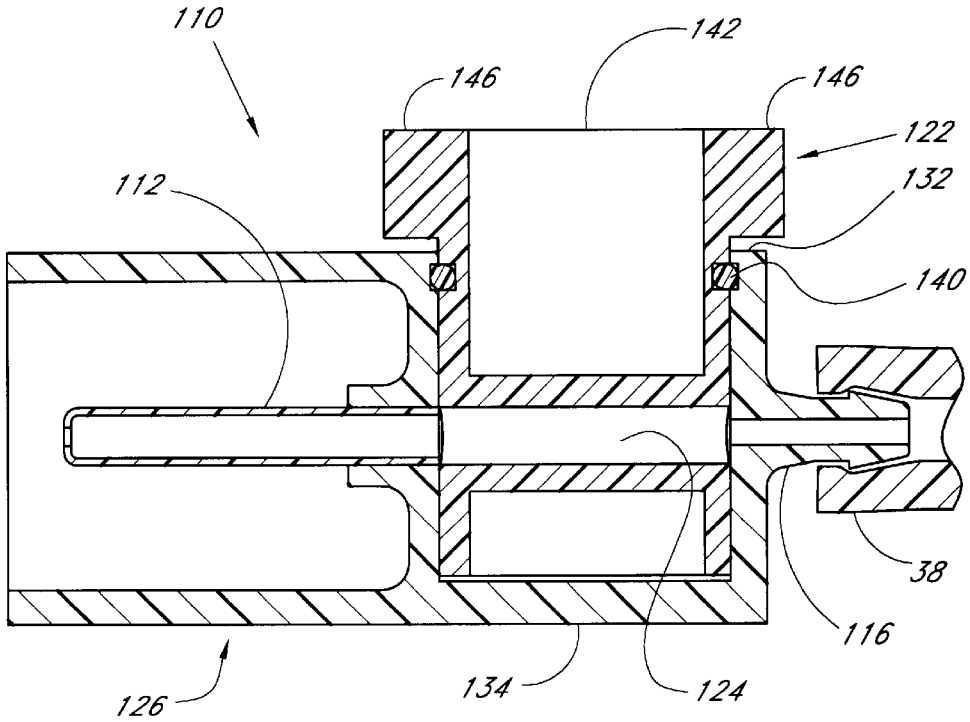
FIG. 8

INK SUPPLY SYSTEM FOR AN INK JET PRINTER

CROSS REFERENCE TO RELATED APPLICATIONS

This application claims priority under 35 U.S.C. Section 119(e) to U.S. Provisional Application Ser. No. 60/262,234 filed on Jan. 16, 2001.

BACKGROUND OF THE INVENTION

1. Field of the Invention

The invention relates to providing a supply of ink via tubing to ink jet print heads in an ink jet printer.

2. Description of the Related Art

In many ink jet printers, sealed ink jet cartridges containing a fixed supply of ink are utilized. The cartridges are passed over the paper, and ink is ejected from the cartridge to form the image. When the ink in a particular cartridge has been depleted, the cartridge is replaced. To maximize print head use, some printers incorporate separate stationary large volume ink supplies, and the ink in these supplies is routed via tubing from the external supply to the print cartridges. One system of this type is described in U.S. Pat. No. 5,686,947 issued on Nov. 11, 1997. The disclosure of this patent is hereby incorporated by reference in its entirety.

Print quality is highly dependent on accurate ink droplet placement on the media. Accordingly, any deviations in print head position during printing (other than the desired print head scanning motion across the media) can result in inaccurate drop placement and/or size, and thus reduce image quality.

One source of print head position variation can arise from the ink supply tubing that is connected to the moving carriage that holds the ink jet cartridges. External forces from the ink supply tubing can be transmitted to the carriage, causing vibrations and other positional deviations of the cartridges as they pass over the media. In some printer embodiments, the weight of the ink supply tubing that is supported by the carriage varies with carriage position from one side of the printer to the other. In these cases, the carriage can be forced to rock backward and forward around its support shaft as the weight of the tubing increases and decreases during passes over the media. Because this positional deviation is consistent with carriage location during a scan, print errors caused by this problem appear as visible vertical banding in the printed image.

SUMMARY OF THE INVENTION

In one embodiment, the invention is directed to a method of reducing drop position errors during ink jet printing comprising separating a movable print carriage into first and second rotationally de-coupled portions and mounting ink applicators to only one of the portions. In a specific embodiment, a device for use in an ink jet printer for mitigating ink drop placement error caused by the weight of various carriage components comprises first and second carriage portions, the first carriage portion being configured to receive a plurality of ink jet cartridges, and the second carriage portion being configured to couple to a cable chain adapted to support ink supply tubing. In this embodiment, the first and second carriage portions are non-rigidly coupled such that they are substantially coupled in linear motion along a common axis, and substantially de-coupled in rotational movement about the axis.

In another embodiment, an ink jet printer comprising first and second carriage portions movably mounted on a guide rod, the first carriage portion being adapted to receive at least one ink jet cartridge, and the second carriage portion being mounted to the guide rod by first and second side plates positioned adjacent to corresponding first and second ends of the first carriage portion whereby axial movement of the first or second carriage portion will cause corresponding axial movement of the other carriage portion; and whereby the first and second carriage portions are rotationally independent.

The invention also includes a method of making an ink jet printer comprising mounting first and second carriage portions on a guide rod such that the second carriage portion is substantially rigidly mounted on side plates which are moveably mounted on the guide rod, and the first carriage portion is moveably mounted on the guide rod interjacent the side plates.

DESCRIPTION OF THE DRAWINGS

FIG. 7 is a perspective assembly view of an ink outlet valve of FIG. 6

FIG. 8 is a section view of the ink outlet valve of FIG. 6

DETAILED DESCRIPTION OF THE PREFERRED EMBODIMENT

Embodiments of the invention will now be described with reference to the accompanying Figures, wherein like numerals refer to like elements throughout. The terminology used in the description presented herein is not intended to be interpreted in any limited or restrictive manner, simply because it is being utilized in conjunction with a detailed description of certain specific embodiments of the invention. Furthermore, embodiments of the invention may include several novel features, no single one of which is solely responsible for its desirable attributes or which is essential to practicing the inventions herein described.

Figure 1:
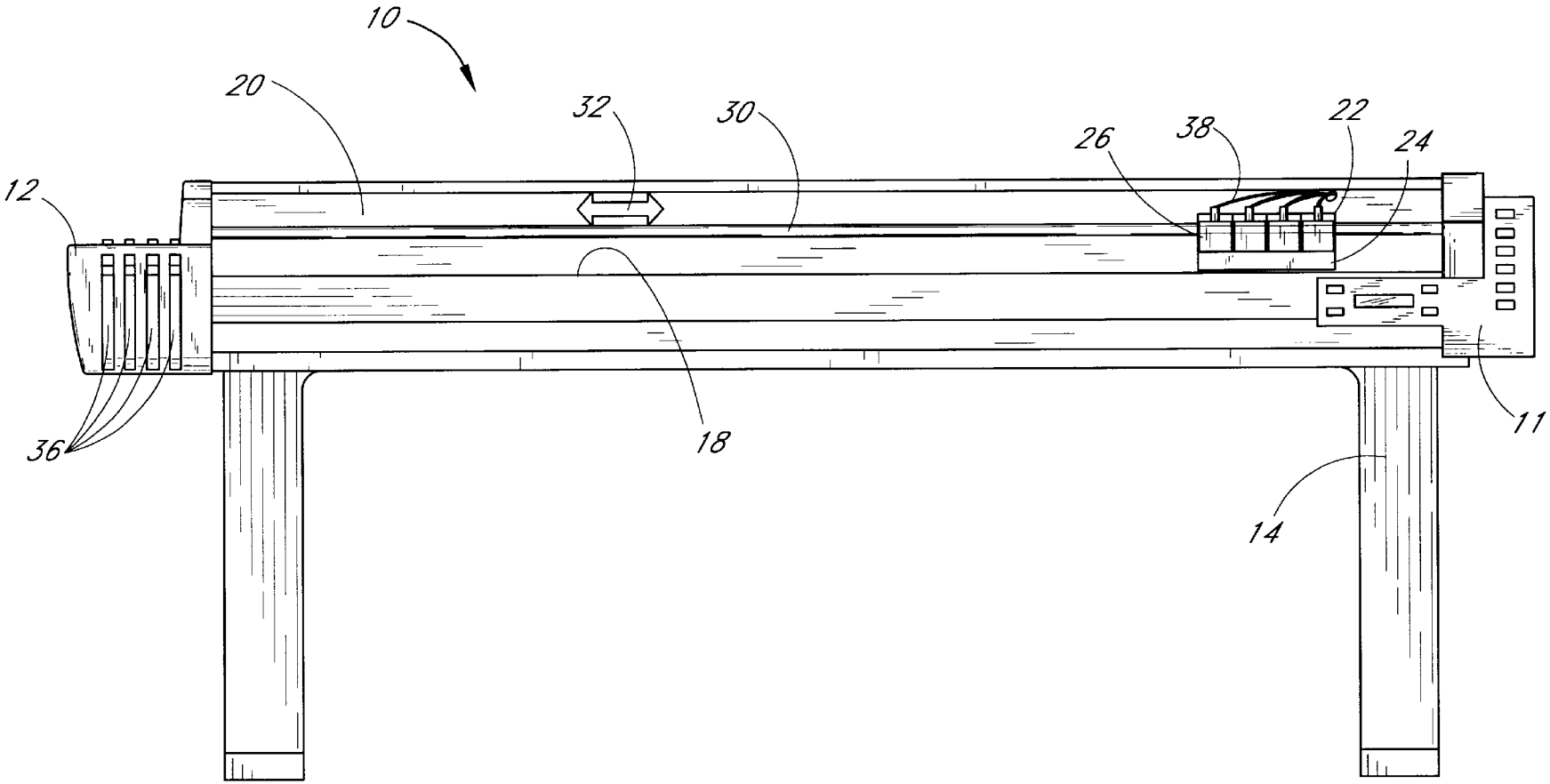
FIG. 1 is a front view of a floor standing ink jet printer.

Referring to FIG. 1, one specific embodiment of a large format ink jet printer 10 includes right and left side housings 11, 12, and is supported by a pair of legs 14. The right housing 11, shown in FIG. 1 with a display and keypad for operator input and control, encloses various electrical and mechanical components related to the operation of the printer 10, but is not directly pertinent to the present invention. The left housing 12 encloses ink reservoirs 36 which feed ink to the ink-jet cartridges 26 via plastic conduits 38, which run between each ink-jet cartridge 26 and each ink reservoir 36. In some printer embodiments, no separate ink reservoirs 36 or tubing 38 is provided, and printing is performed with ink reservoirs integral to the cartridges.

Either a roll of continuous print media (not shown) is mounted to a roller on the rear of the printer 10 to enable a continuous supply of paper to be provided to the printer 10 or individual sheets of paper (not shown) are fed into the printer 10. A platen 18 forms a horizontal surface which supports the print media, and printing is performed by select deposition of ink droplets onto the paper. During operation, a continuous supply of paper is guided from the roll of paper mounted to the rear of the printer 10 across the platen 18 by a plurality of upper rollers (not shown) which are spaced along the platen 18. In an alternate embodiment, single sheets of paper or other print media are guided across the platen 18 by the rollers (not shown). A support structure 20 is suspended above the platen 18 and spans its length with sufficient clearance between the platen 18 and the support structure to enable a sheet of paper or other print media which is to be printed on to pass between the platen 18 and the support structure 20.

The support structure 20 supports a print carriage 22 above the platen 18. The print carriage 22 includes a plurality of ink-jet cartridge holders 24, and a plurality of replaceable ink-jet cartridges 26 mounted therein. In a preferred embodiment, four print cartridges 26 are mounted in the holders 24 on the print carriage 22, although it is contemplated that any number ink-jet cartridges 26 may be provided. The support structure 20 generally comprises a guide rod 30 positioned parallel to the platen 18. The print carriage 22 preferably comprises split sleeves which slidably engage the guide rod 30 to enable motion of the print carriage 22 along the guide rod 30 to define a linear printing path, as shown by the bi-directional arrow 32, along which the print carriage 22 moves. A motor and a drive belt mechanism (not shown) are used to drive the print carriage 22 along the guide rod 30.

During printing, the carriage 22 passes back and forth over the media (not shown). During each pass, the ink jet cartridges 26 deposit a swath of ink having a width approximately equal to the width of the ink jet nozzle array of the jet plate on the bottom of the cartridge 26. After each pass, the media is incremented, and the carriage 24 is passed back over the media to print the next swath. Depending on the printing mode, the ink jet cartridges 26 could print during passes in only one or both directions. Furthermore, in multi-pass print modes, the ink jet cartridges may deposit ink over the same location of the media more than once. These aspects of ink jet printers are well known and conventional, and thus will not be explained in further detail herein.

Figure 2:
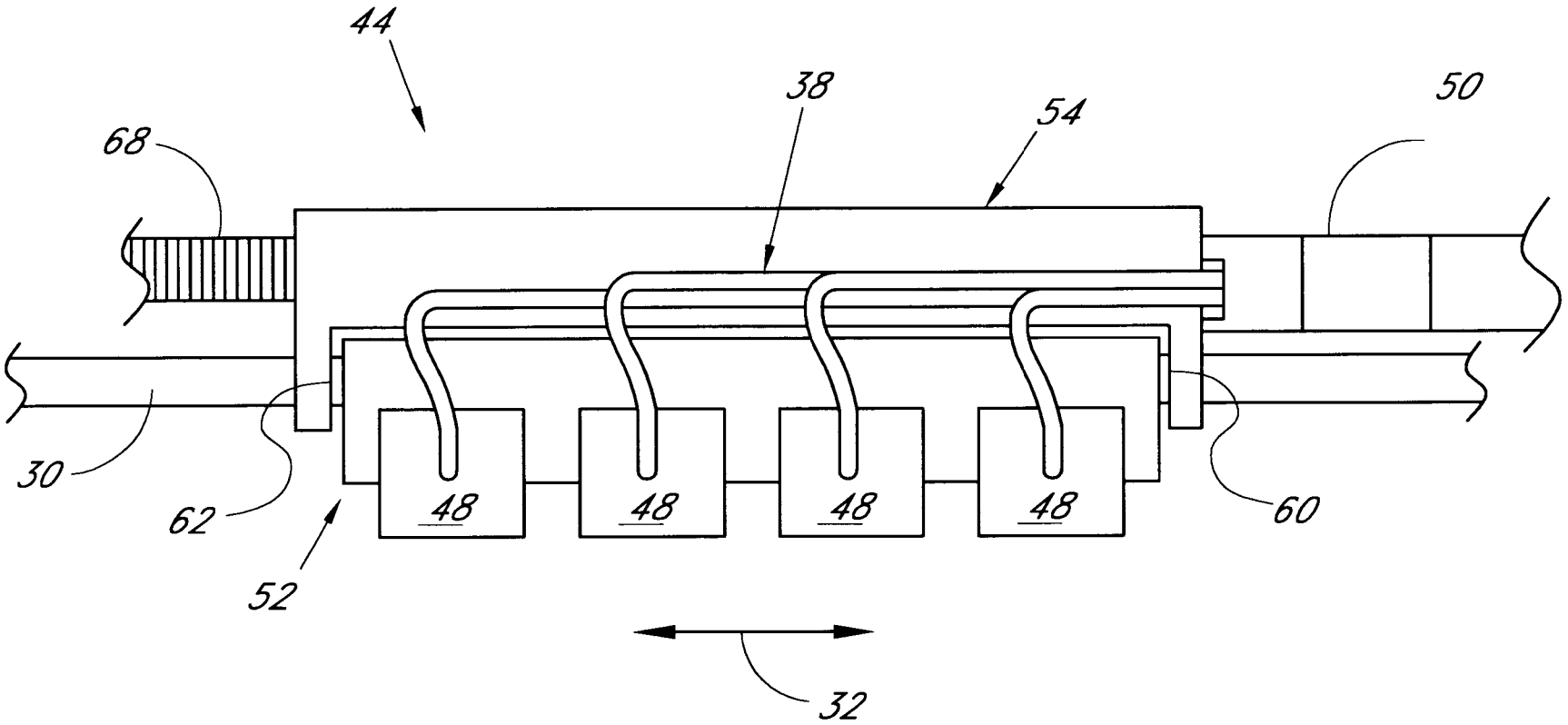
FIG. 2 is a schematic top view of a carriage and tubing supply in accordance with one embodiment of the invention.

FIG. 2 schematically shows a top view of an ink jet printer incorporating a movable print carriage 44 constructed in accordance with one embodiment of the invention. As described above with reference to FIG. 1, the print carriage 44 is mounted on a guide rod 30 and moves back and forth in the direction of the bi-directional arrow 32 over a platen (not shown). Between the platen and the carriage 44 is the media (not shown) being printed. The carriage 44 mounts one or more ink applicators 48, which, for example, may comprise the four ink jet cartridges 26 illustrated in FIG. 1, although any type of ink applicator device or method may be used in conjunction with the invention.

The ink applicators/cartridges 48 are supplied with ink from reservoirs (such as, for example, the reservoirs designated 36 in FIG. 1), for example, via tubing 38 which may be routed to the carriage 44 inside a cable chain 50. The cable chain 50 preferably comprises a plurality of hollow moveable sections which cooperate in order to guide the motion of the supply tubing 38 and any electrical wires which may be desired. Suitable cable chain is well known in the art and is commercially available, for example, from Igus Corp.

In one embodiment of the present invention as shown in FIG. 2, the carriage 44 comprises two non-rigidly coupled portions 52 & 54. A first portion 52 provides mounts for the ink applicators/cartridges 48, and is configured such that it may hold conventional cartridges provided on some currently commercially available ink jet printers. A second portion 54 provides a coupling point for the cable chain 50 through which the ink supply tubing 38 may be routed. A drive belt 68, which may be coupled to either carriage portion 52, 54, is used to produce axial motion of the assembly during the printing process.

The two carriage portions 52, 54 are independently supported by the guide rod 30 and are in contact with one another only at mating surfaces 60, 62. Thus, when the drive belt 68 forces one of the carriage portions to be linearly displaced along the axis of the guide rod 30, as indicated by the bi-directional arrow 32 in FIG. 2, the other carriage portion is also displaced axially by contact with the belt driven carriage portion at the mating surfaces 60, 62. The contact at the mating surfaces 60, 62 is slidable such that the two carriage portions 52, 54 may rotate independently. Specifically, with respect to rotation about the longitudinal axis of the guide rod 30, the first and second carriage portions 52, 54 will be free to rotate independently. Thus, if the weight of the cable chain 50 and associated tubing 38 forces the second carriage portion 54 to rotate forward and backward (as viewed in FIG. 2) slightly as the carriage 44 reciprocates along the guide rod 30, the sliding contact at mating surfaces 60, 62 will allow this motion to occur without causing similar displacements in the first carriage portion 52. With this design, the positioning of the cartridges 48 with respect to the media underneath is more stable than prior art carriages in which the tubing is coupled to the same part that holds the cartridges.

Figure 3:
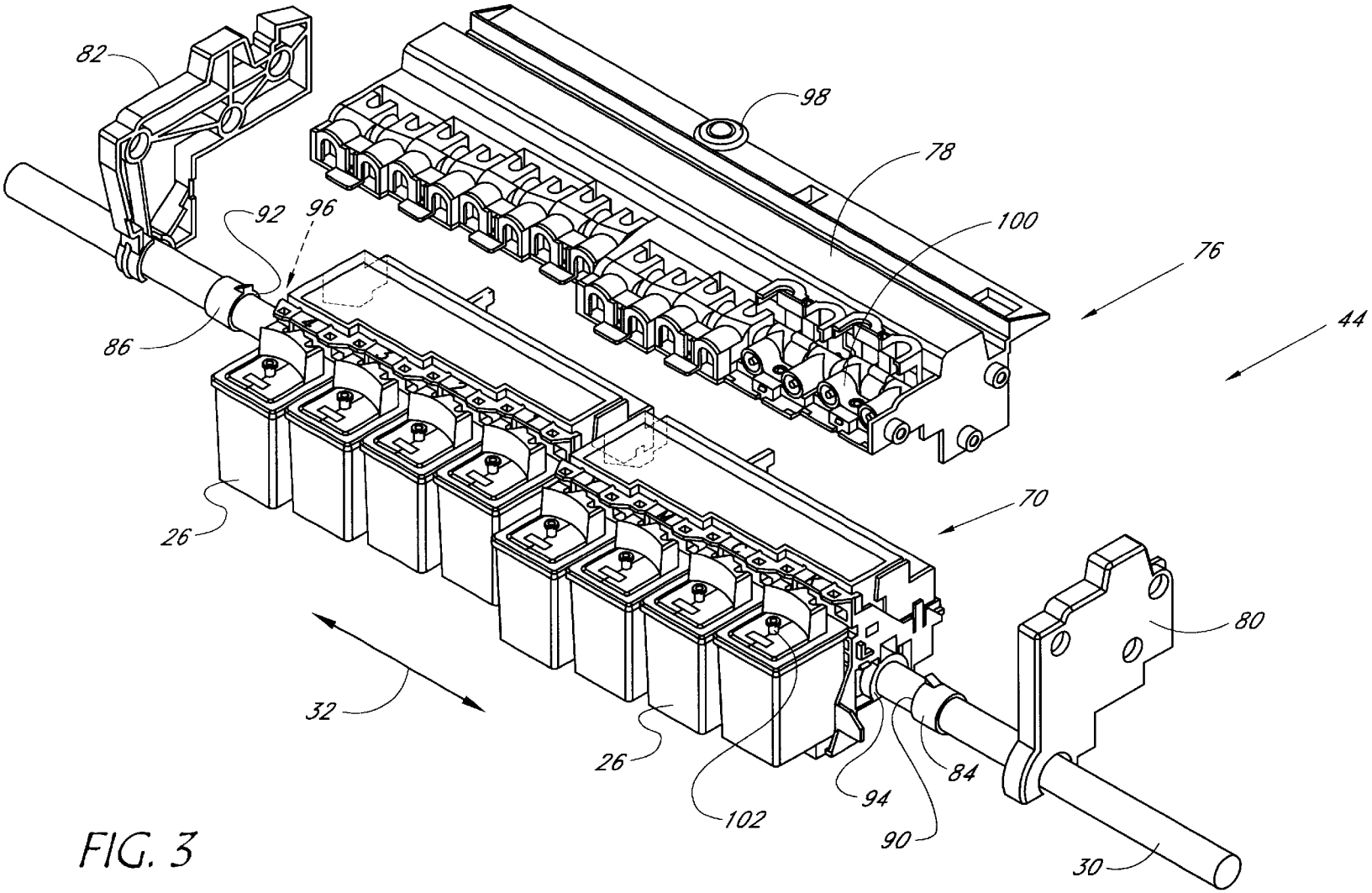
FIG. 3 is an exploded perspective view of a two part carriage in accordance with one embodiment of the invention.

FIG. 3 illustrates another embodiment of the invention wherein the carriage 44 holds eight ink jet cartridges 26. In this embodiment, the first carriage portion 70 mounts to a guide rod 30 on split sleeves as described above, and is adapted to comprise holders for one or more ink jet cartridges 26. The rotational position of the first carriage portion 70 about the guide rod 30 is maintained by a flange (not shown) which extends from the rear of the carriage portion 70 and slide along a surface of a support structure (not shown) provided as part of the printer.

A second carriage portion 76 comprises an upper cover 78 that couples to the ink supply tubing via the cable chain as described above with reference to FIG. 2. The upper cover 78 is preferably adapted such that it contains a plurality of ink outlets 100. The upper cover 78 is preferably affixed to a pair of side plates 80, 82 which mount to bushings 84, 86 that are slidably mounted on the guide rod 30. The inner edges 90, 92 of the bushings 84, 86 respectively contact outer edges 94, 96 of the attachment section of the first carriage portion 76 to provide mating surfaces.

The second carriage portion 76 may be maintained in a substantially constant rotational position about the guide rod 30 by a wheel 98 which rides along a track (not shown) in the printer support structure (FIG. 1). Contact between the first carriage portion 70 and the second carriage portion 76 (comprising cover 78, side plates 80, 82, and split sleeve bushings 84, 86) is essentially limited to the surfaces 90, 92, 94, 96 so as to de-couple the rotational motions of the two carriage portions 70, 76 as the carriage moves axially back and forth along the guide rod 30 during printing.

The first and second carriage portions 70, 76, the side plates 80, 82, and the bushings 84, 86 are preferably made from a suitable molded plastic. Alternatively, they may be made from any other material known in the art to be suitable. The guide rod 30 is preferably a stainless steel rod, although it may alternatively be made of any other appropriate material. The guide rod 30 is shown as having a circular cross-section, but it may alternatively comprise any cross section such that it functions as described herein. The bushings 84, 86 are preferably press-fit or glued into the side plates 80, 82. Alternatively, bushings 84, 86 the may be integrally formed as part of the side plates 80, 82.

According to the carriage arrangement shown in FIG. 3 the cover 78 houses sixteen (16) ink outlets 100. In this embodiment, the ink outlets 100 are paired such that two ink outlets 100 may alternatively be connected to a single cartridge 48. Those skilled in the art will recognize that any number of cartridges 48 and outlets 100 may be used without departing from the spirit of the present invention. The ink outlets 100 preferably comprise valves (see FIG. 6) to allow the easy replacement of ink jet cartridges 26, with a minimum amount of ink leakage and air ingress during the replacement process.

Figure 4:
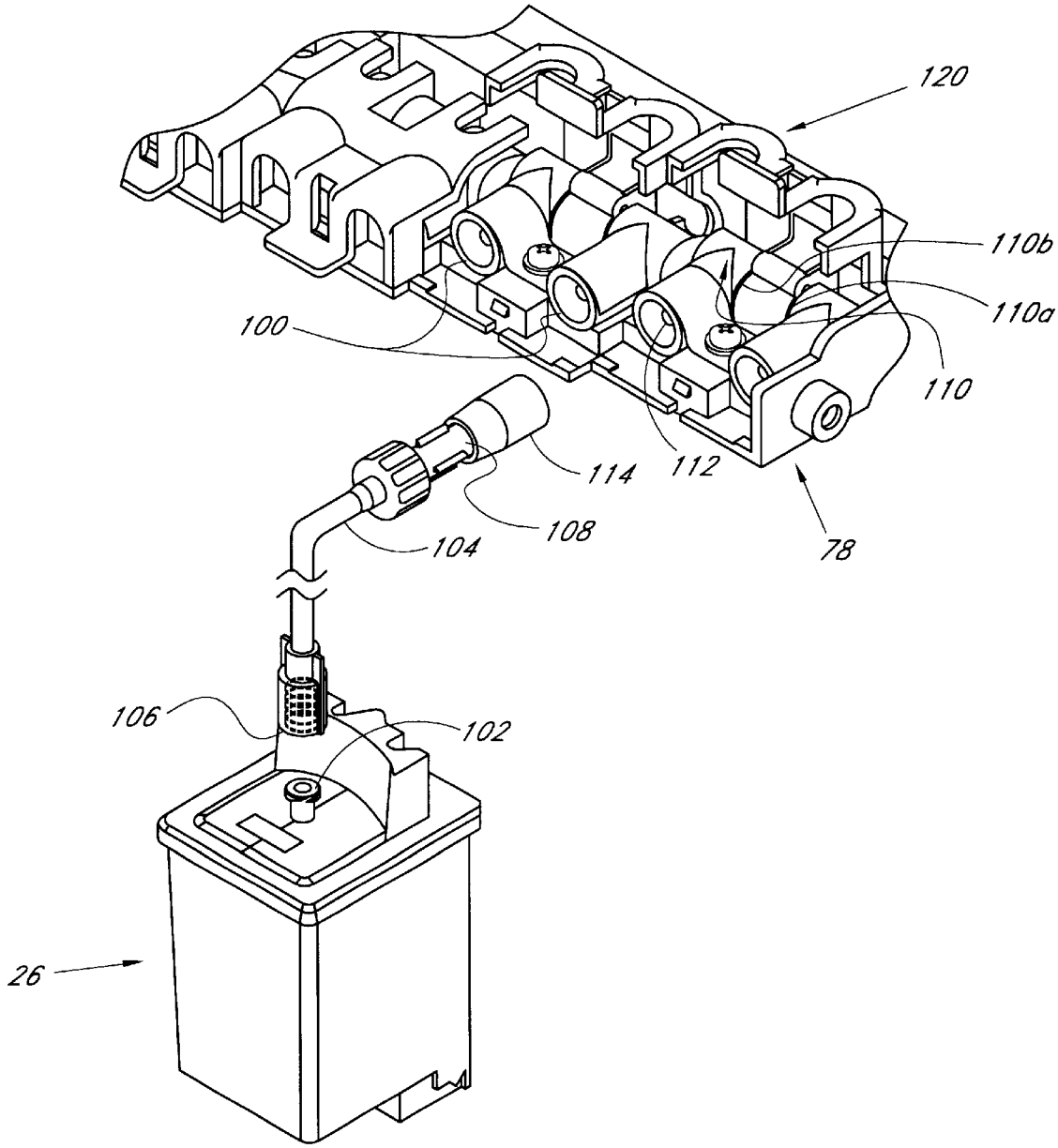
FIG. 4 is an exploded perspective view of a cartridge and ink outlet connection with outlet valves open.
Figure 5:
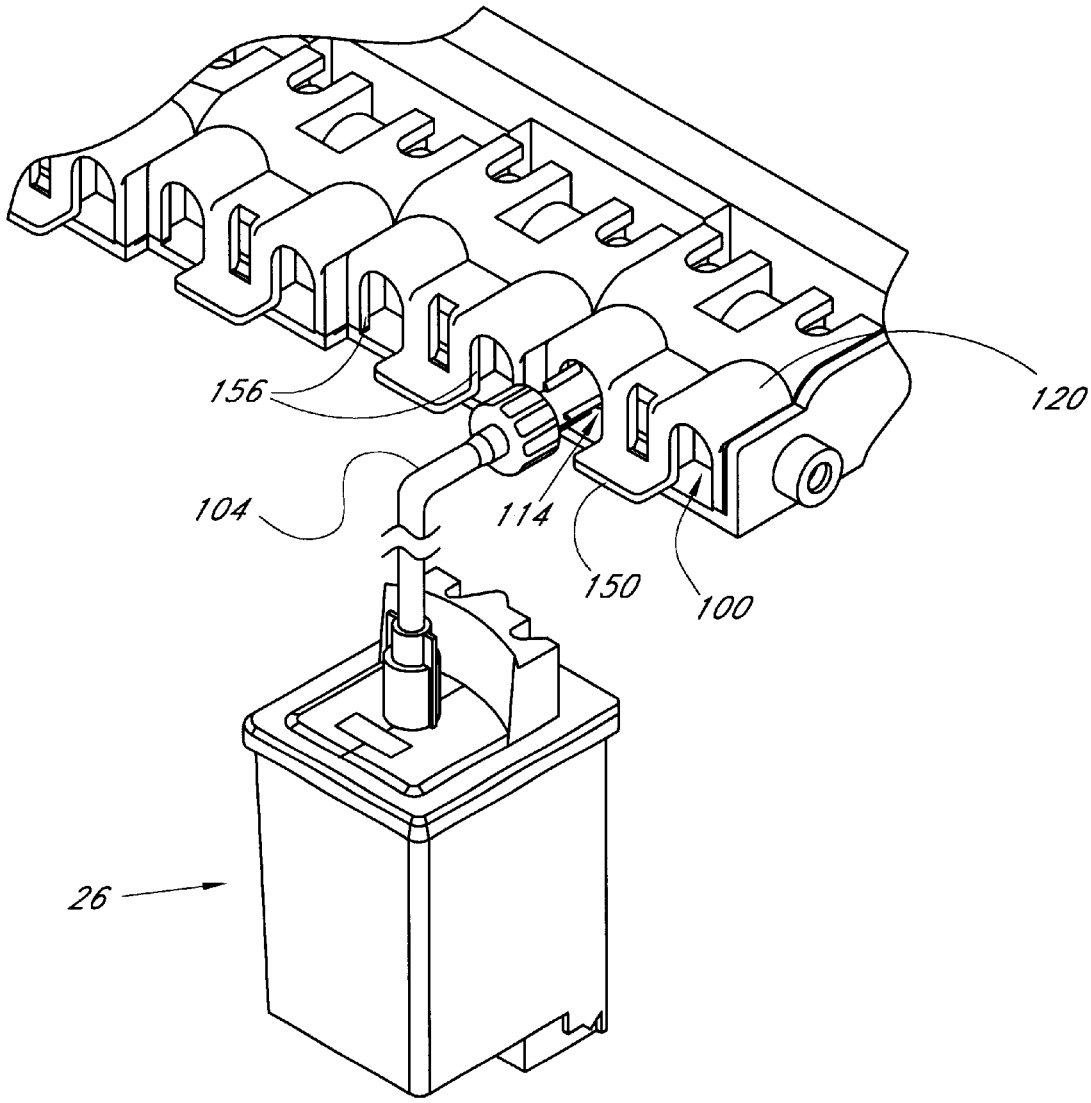
FIG. 5 is an exploded perspective view of the cartridge and ink outlet connection of FIG. 4 with outlet valves closed.

FIGS. 4 and 5 illustrate in greater detail an advantageous ink supply apparatus briefly discussed above with reference to FIG. 3. Specifically, the connection between the ink outlets 100 and the ink cartridges 26 is shown. Ink is supplied to a cartridge 26 via a connecting tube 104 which has first and second ends 106, 108. The first end 106 of the connecting tube 104 is preferably connected to a coupler 102 provided on the ink jet cartridges 26, the second end 108 advantageously includes a self sealing septum 114 that is pushed over a needle 112 on the ink outlet valve 110 when the connecting tube 104 is installed.

Connecting tubes 104 used in conjunction with the present invention are preferably substantially flexible tubes of polyvinyl or other appropriate material such that the connecting tubes 104 will allow the two carriage portions (see FIGS. 2 & 3) to rotate independently as described above. The ink outlets 100 are supplied with ink via a supply tube 38 (FIG. 2) connected to a barbed fitting 116 (FIG. 6) on the ink outlet valve at the proximal end of the supply tube 38 (FIG. 2), and connected to an ink reservoir 36 (FIG. 1) at the supply tube 38 (FIG. 2) distal end.

Figure 6:
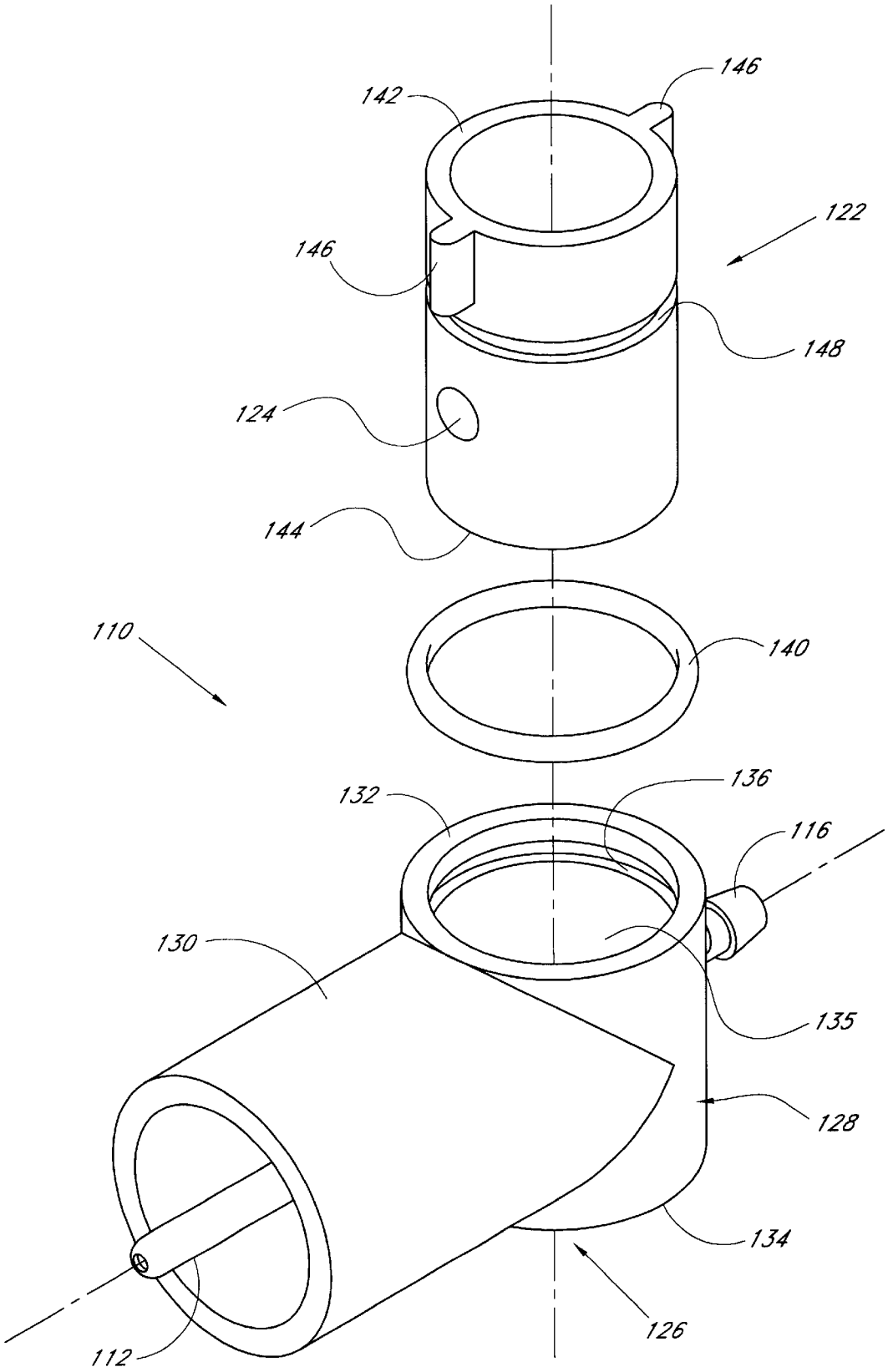
FIG. 6 is an exploded perspective view of an ink outlet valve in accordance with one embodiment of the invention.

A specific embodiment of a valve 110 is illustrated in FIGS. 6–8. In this embodiment, a valve 110 having features and advantages of the present invention is characterized by a substantially cylindrical plug 122 with a passageway 124, inserted into a valve body 126 which includes a needle 112 and a hose barb 116. The plug 122 is preferably rotatable within the valve body 126 between open and closed orientations by the movement of an actuator 120 as described below. The plug 122, valve body 126, and actuator 120 may be injection molded from a suitable thermoplastic, or they may be formed by any other process or material known to those skilled in the art.

A valve body 126 is preferably characterized by first 128 and second 130 hollow cylinders intersecting at a substantially right angle. The first and second cylinders are preferably integrally formed as a unitary molded part, but the valve body 126 may be machined or otherwise formed such that the advantages taught herein are provided. The first cylinder 128 preferably comprises an open end 132 and a closed end 134; and a needle 112 extending radially out from its outer surface which is in fluid communication with the interior of the first cylinder 128; and a hose barb 116, which is substantially in line with the needle 112 on the opposite side of the first cylinder 128, and is also in fluid communication with the interior 135 of the first cylinder 128. In some embodiments, the first cylinder 128 may comprise a groove 136 formed on its internal surface. The groove 136 is preferably adapted to retain an O-ring 140 in order seal the plug 122 within the valve body.

The second cylinder 130 preferably intersects the first cylinder 128 at a right angle such that the second cylinder 130 is substantially coaxial with the needle 112. The needle 112 is preferably shorter than the second cylinder 130, but as shown in FIG. 6, the needle 112 may also be longer than the second cylinder 130 if desired. The second cylinder 130 is also preferably sized such that the septum 114 will form a seal around the needle 112.

The plug 122 is preferably substantially cylindrical, and has first and second ends 142 & 144 (respectively). The passageway 124 is preferably located toward the second end 144 of the plug 122. The plug 122 preferably comprises flanges 146 substantially near the first end 142. The plug 122 may also comprise a groove 148 about the circumference of the plug 122 adapted to receive the O-ring 140. The O-ring 140 may be made of any suitable flexible material.

The plug 122 is preferably sized such that it is insertable into the open end 132 of the first cylinder 128 of the valve body 126 such that the flanges 146 rest substantially near the open end of the first cylinder 128. The O-ring 140 preferably rests in the groove 148 on the plug 122 and the groove 136 on the interior of the first cylinder 128, which are preferably aligned when the valve is assembled.

The plug 122 is thus rotatable within the valve body 126. In one plug orientation, the passageway 124 is aligned with the needle 112 and the hose barb 116 such that they are coupled for fluid communication. This orientation will be referred to herein as the open position. Rotation of the plug 122 relative to the valve body 126 causing misalignment between the passage 124 through the plug and the needle/hose barb on the valve body places the valve in a closed position. The O-ring 140 preferably functions to help prevent any ink from leaking out the open end of the first cylinder 132 of the valve body 128, and to retain the plug 122 within the valve body 126.

As illustrated in FIGS. 4 and 5, an actuator 120 is provided at the ink outlets 100 in order to control the valve 110. The actuator 120 is preferably adapted such that when it is lifted (as shown in FIG. 4), the valve 110 is closed thus stopping the flow of ink through the ink outlet 100. With the actuator lifted, the septum 114 may be removed from the ink outlet 100. Once a new connecting tube 104 and septum 114 have been installed, the actuator 120 may be lowered to re-open the valve 110. Advantageously, the septum 114 is sized so that the actuator 120 cannot be lowered (due to mechanical interference between the actuator and the septum body) unless the septum 114 is fully seated over the needle 112.

Figure 9:
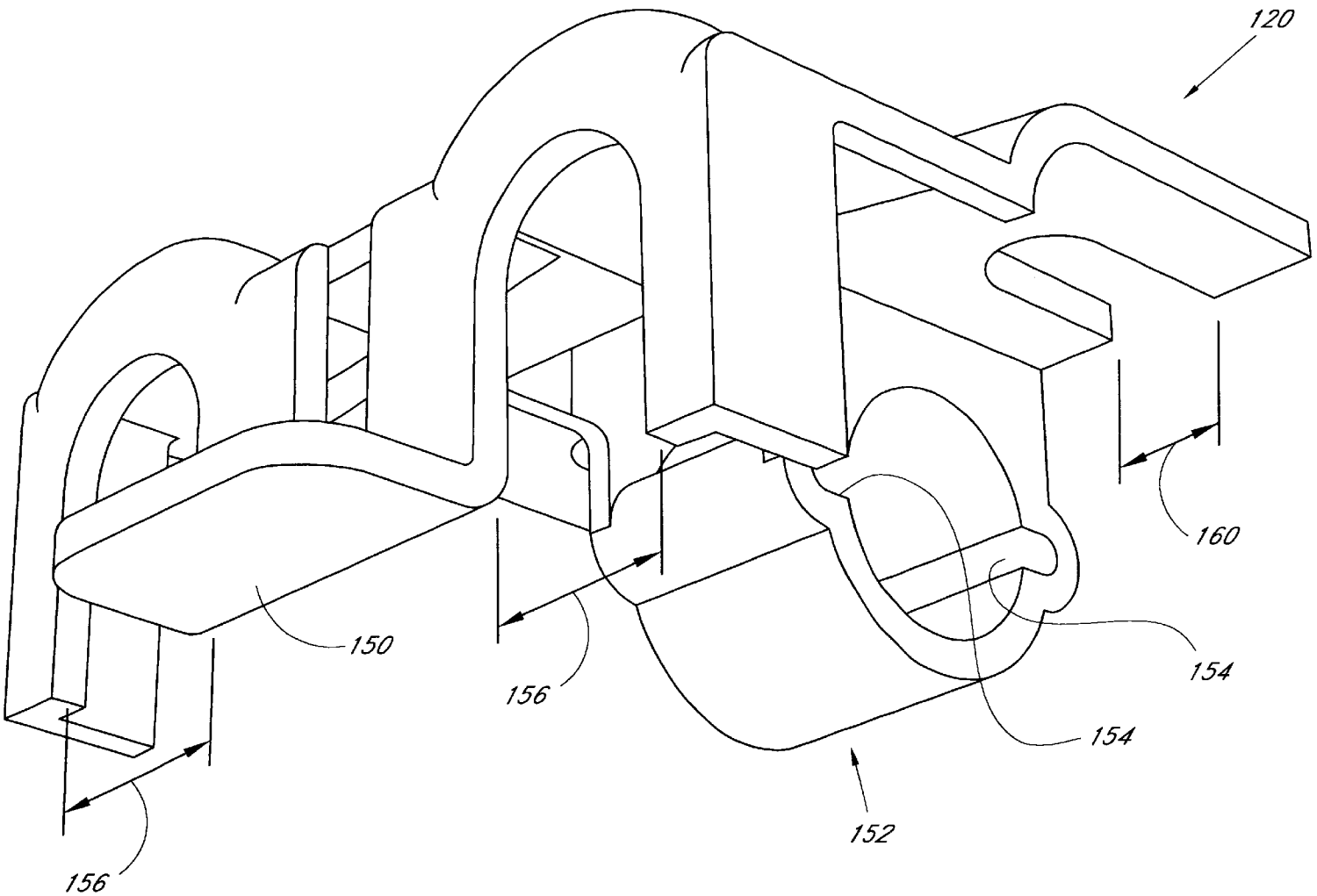
FIG. 9 is a perspective view of an ink outlet valve actuator in accordance with one embodiment of the present invention

An actuator 120 is shown in detail in FIG. 9. The actuator 120 is preferably adapted such that it may simultaneously control two valves 110. The actuator 120 preferably comprises a tab 150 which extends forward, and is engageable by a user to raise and lower the actuator 120. The actuator 120 preferably comprises a sleeve 152 having slots 154 adapted to receive the flanges 146 of the plug 122 (FIG. 7). The actuator 120 preferably further comprises a pair of forward openings 156. As seen best in FIG. 5, the openings 156 are preferably sized to be smaller than the septum 114 attached to the connecting tube 104, thus the septum 114 will be retained within the valve 110 by the actuator 120. The actuator 120 is also preferably configured with rearward openings 160 such that it will not interfere with the hose barb 116 or the supply tube when the actuator 120 is lifted (as shown in FIG. 4).

The ink supply apparatus may be assembled as shown in FIGS. 4 and 5. In one embodiment, the ink outlet valves 110 are mounted to the top cover 78 on their sides such that the plugs 122 of two adjacent valves 110*a* and 110*b* extend horizontally toward each other and are engaged by a single actuator 120. The flanges 146 on the plug 122 of the ink outlet valves 110, are coupled in the slots 154 in the sleeve 152 of the actuator 120 (FIG. 9) such that raising and lowering the actuator 120 rotates the plugs 122 (FIG. 7), and closes and opens the valves 110.

The foregoing description details certain embodiments of the invention. It will be appreciated, however, that no matter how detailed the foregoing appears in text, the invention can be practiced in many ways. As is also stated above, it should be noted that the use of particular terminology when describing certain features or aspects of the invention should not be taken to imply that the terminology is being re-defined herein to be restricted to including any specific characteristics of the features or aspects of the invention with which that terminology is associated. The scope of the invention should therefore be construed in accordance with the appended claims and any equivalents thereof.

What is claimed is:

1. A device for use in an ink jet printer for mitigating ink drop placement error caused by the weight of various carriage components, said device comprising:

first and second carriage portions, said first carriage portion being configured to receive a plurality of ink jet cartridges, and said second carriage portion being configured to couple to a cable chain adapted to support ink supply tubing;

said first and second carriage portions being non-rigidly coupled to each other such that they are moved together along a common axis, and substantially de-coupled to each other such that said first carriage portion is rotatable relative to said second carriage portion about said axis.

2. The device of claim 1 wherein said second carriage portion comprises a plurality of ink outlets.

3. The device of claim 2 wherein said outlets comprise valves.

4. The device of claim 3 wherein said valves comprise actuators, said actuators being moveable between first and second positions corresponding with valve-open and valve-closed conditions.

5. The device of claim 3 wherein said valves comprise actuators, said valves being disposed such that two valves are opened and closed by a single actuator.

6. The device of claim 1 wherein the second carriage portion has a plurality of ink outlets and said cartridges are supplied with ink via connecting tubes attaching to said outlets and said cartridges.

7. The device of claim 1 wherein said printer comprises a support structure, and wherein said first carriage portion is adapted to be rotationally supported by a portion of the support structure.

8. The device of claim 1 wherein said printer comprises a support structure, and wherein said second carriage portion is adapted to be rotationally supported by a wheel in contact with a portion of the support structure.

9. An ink jet printer comprising:

first and second carriage portions movably mounted on a guide rod, said first carriage portion being adapted to receive at least one ink jet cartridge, and said second carriage portion being mounted to said guide rod by first and second side plates positioned adjacent to corresponding first and second ends of said first carriage portion, said second carriage portion being pivotably mounted on the guide rod between but not rigidly attached to the first and second side plates.

10. The printer of claim 9 wherein said second carriage portion includes at least one ink outlet.

11. The printer of claim 10 wherein said at least one ink outlet has a valve.

12. The printer of claim 10 comprising a plurality of ink outlets, each outlet having a valve.

13. The printer of claim 12 wherein said valves comprise actuators, said actuators being moveable between first and second positions corresponding with valve-open and valve-closed conditions.

14. The printer of claim 13 wherein the actuators are disposed such that two valves are opened and closed by a single actuator.

15. The printer of claim 10 wherein the second carriage has a plurality of ink outlets and said cartridges are supplied with ink via connecting tubes, said connecting tubes attaching to said ink outlets with a self-sealing septum, and extending to said ink cartridges.

16. The printer of claim 10 wherein said printer comprises a support structure, and wherein said first carriage portion is adapted to be rotationally supported by a portion of the support structure.

17. The printer of claim 10 wherein said printer comprises a support structure, and wherein said second carriage portion is adapted to be rotationally supported by a wheel in contact with a portion of the support structure.

18. A method of making an ink jet printer comprising:

providing a first carriage portion comprising side plates adapted to slidably mount on a guide rod;

mounting said first carriage portion on a guide rod using said side plates;

mounting a second carriage portion which is separate from said first carriage portion between said side plates.

19. An ink jet printer comprising:

first and second carriage portions movably mounted on a guide rod, said first carriage portion being adapted to receive at least one ink jet cartridge, and said second carriage portion being mounted to said guide rod by first and second side plates positioned adjacent to corresponding first and second ends of said first carriage portion;

whereby axial movement of either said first carriage portion or said second carriage portion will cause corresponding axial movement of the other carriage portion; and whereby said first and second carriage portions are rotationally independent;

wherein said second carriage portion includes at least one ink outlet; and wherein said printer comprises a support structure, and wherein said second carriage portion is adapted to be rotationally supported by a wheel in contact with a portion of the support structure.

20. A device for use in an ink jet printer for mitigating ink drop placement error caused by the weight of various carriage components, said device comprising:

first and second carriage portions, said first carriage portion being configured to receive a plurality of ink jet cartridges, and said second carriage portion being configured to couple to a cable chain adapted to support ink supply tubing;

wherein said first and second carriage portions are non-rigidly coupled such that they are substantially coupled in linear motion along a common axis, and substantially de-coupled in rotational movement about said axis;

a plurality of ink outlets attached to said second carriage portion, wherein said outlets comprise valves, and wherein said valves comprise actuators, said valves being disposed such that two valves are opened and closed by a single actuator.

21. A device for use in an ink jet printer for mitigating ink drop placement error caused by the weight of various carriage components, said device comprising:

first and second carriage portions, said first carriage portion being configured to receive a plurality of ink jet cartridges, and said second carriage portion being configured to couple to a cable chain adapted to support ink supply tubing;

wherein said first and second carriage portions are non-rigidly coupled such that they are substantially coupled in linear motion along a common axis, and substantially de-coupled in rotational movement about said axis;

wherein said printer comprises a support structure, and wherein said second carriage portion is adapted to be rotationally supported by a wheel in contact with a portion of the support structure.

22. An ink jet printer comprising:

first and second carriage portions movably mounted on a guide rod, said first carriage portion being adapted to receive at least one ink jet cartridge, and said second carriage portion being mounted to said guide rod by first and second side plates positioned adjacent to corresponding first and second ends of said first carriage portion;

whereby axial movement of either said first carriage portion or said second carriage portion will cause corresponding axial movement of the other carriage portion; and whereby said first and second carriage portions are rotationally independent;

said second carriage portion including a plurality of ink outlets, each ink outlet having a valve;

wherein said valves comprise actuators, said actuators being moveable between first and second positions corresponding with valve-open and valve-closed conditions; and wherein the actuators are disposed such that two valves are opened and closed by a single actuator.

* * * * *